US012735981B2

(12) United States Patent
Hohl

(10) Patent No.: US 12,735,981 B2
(45) Date of Patent: Sep. 15, 2026

(54) UTILIZING DYNAMICS DATA AND TRANSFER FUNCTION FOR FORMATION EVALUATION

(71) Applicant: Baker Hughes Oilfield Operations LLC, Houston, TX (US)

(72) Inventor: Andreas Hohl, Hannover (DE)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 18/394,129

(22) Filed: Dec. 22, 2023

(65) Prior Publication Data

US 2024/0218791 A1 Jul. 4, 2024

Related U.S. Application Data

(60) Provisional application No. 63/436,149, filed on Dec. 30, 2022.

(51) Int. Cl.
*E21B 49/00* (2006.01)

(52) U.S. Cl.
CPC ..... *E21B 49/005* (2013.01)

(58) Field of Classification Search
CPC ..... E21B 49/003; E21B 49/005
See application file for complete search history.

(56) References Cited

U.S. PATENT DOCUMENTS

| | | | | |
|---|---|---|---|---|
| 3,520,375 | A * | 7/1970 | Raynal | E21B 49/003 73/152.43 |
| 7,940,192 | B2 | 5/2011 | Reckmann et al. | |
| 9,708,900 | B2 | 7/2017 | Veltman | |
| 11,162,358 | B2 | 11/2021 | Li et al. | |
| 2016/0209503 | A1* | 7/2016 | Zhao | G01S 7/52004 |
| 2016/0348493 | A1* | 12/2016 | Hohl | E21B 4/02 |
| 2017/0152736 | A1 | 6/2017 | Kyllingstad | |
| 2018/0128102 | A1* | 5/2018 | Torres-Verdin | E21B 47/12 |
| 2019/0257197 | A1* | 8/2019 | Palmer | E21B 49/005 |
| 2019/0257972 | A1 | 8/2019 | Palmer et al. | |
| 2020/0392841 | A1* | 12/2020 | Collins | G06N 3/045 |
| 2021/0166115 | A1 | 6/2021 | Yu et al. | |
| 2021/0270120 | A1 | 9/2021 | Hohl et al. | |

(Continued)

OTHER PUBLICATIONS

Hohl, et al. "Real-Time System to Calculate the Maximum Load of High-FrequencyTorsional Oscillations Independent of Sensor Positioning", SPE/IADC-194071-MS, Mar. 2019, 14 pages.

(Continued)

*Primary Examiner* — Giovanna Wright
(74) *Attorney, Agent, or Firm* — CANTOR COLBURN LLP

(57) ABSTRACT

Methods and systems for determining formation properties in subsurface operations include drilling into a formation with a disintegrating device disposed on a downhole string, monitoring dynamics information signals in the downhole string with a dynamics information sensor to obtain dynamics information data, applying a transfer function to the dynamics information data to obtain a dynamics information signature, and analyzing the dynamics information signature to determine a formation property of the formation drilled by the disintegrating device.

20 Claims, 7 Drawing Sheets

(56) References Cited

U.S. PATENT DOCUMENTS

2022/0026336 A1* 1/2022 Ma ..... G01N 29/07
2022/0397029 A1 12/2022 Wicks et al.

OTHER PUBLICATIONS

International Search Report & Written Opinion in International Application No. PCT/US2023/085034, mailed Apr. 29, 2024; 7 pages.
Srinivasan et al, "Conditioning reservoir models to dynamic data—A forward modeling perspective", SPE 62941, Oct. 2000, 16 pages.

* cited by examiner

UTILIZING DYNAMICS DATA AND TRANSFER FUNCTION FOR FORMATION EVALUATION

CROSS-REFERENCE TO RELATED APPLICATIONS

This application claims the benefit of U.S. Provisional Application No. 63/436,149, filed Dec. 30, 2022, the disclosure of which is incorporated herein by reference in its entirety.

BACKGROUND

Subterranean operations are performed in various fields, including fields related to energy production. For example, boreholes or wells are drilled as part of hydrocarbon exploration and production operations, and as part of other energy industry operations such as geothermal production. Various components and devices are often deployed into a borehole to facilitate such operations.

For example, oil and gas wells are typically constructed of casings and tubing, ideally in concentric multilayered cylindrical configurations with annular spaces in-between that are filled with fluids including completion, drilling and or production fluids such as gas, oil, or brine as well as bonding agents that are typically oilfield cements. Determining formation properties is necessary to inform an operator regarding drilling operations and/or production viability of a well or drilling well/borehole.

SUMMARY

Methods for determining formation properties in subsurface operations include drilling into a formation with a disintegrating device disposed on a downhole string, monitoring dynamics information signals in the downhole string with a dynamics information sensor to obtain dynamics information data, applying a transfer function to the dynamics information data to obtain a dynamics information signature, and analyzing the dynamics information signature to determine a formation property of the formation drilled by the disintegrating device.

Systems for determining formation properties in subsurface operations include a disintegrating device disposed on a downhole string and configured to drill into a formation, a dynamics information sensor arranged on the downhole string and configured to obtain dynamics information data from dynamics information signals induced in the downhole string due to a drilling operation with the disintegrating device, and a controller configured to receive the dynamics information data and apply a transfer function to the dynamics information data to obtain a dynamics information signature and analyze the dynamics information signature to determine a formation property of the formation drilled by the disintegrating device.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures. Modern bottom hole assemblies (BHAs) are composed of several distributed components, such as sensors and tools, with each component performing data acquisition and/or processing of a special purpose. During a drilling operation, sensors and detectors may be used to determine the nature of a surrounding formation and/or to determine if the location of the borehole is passing through an expected formation and/or within a specification formation (e.g., for production purposes).

Figure 1:
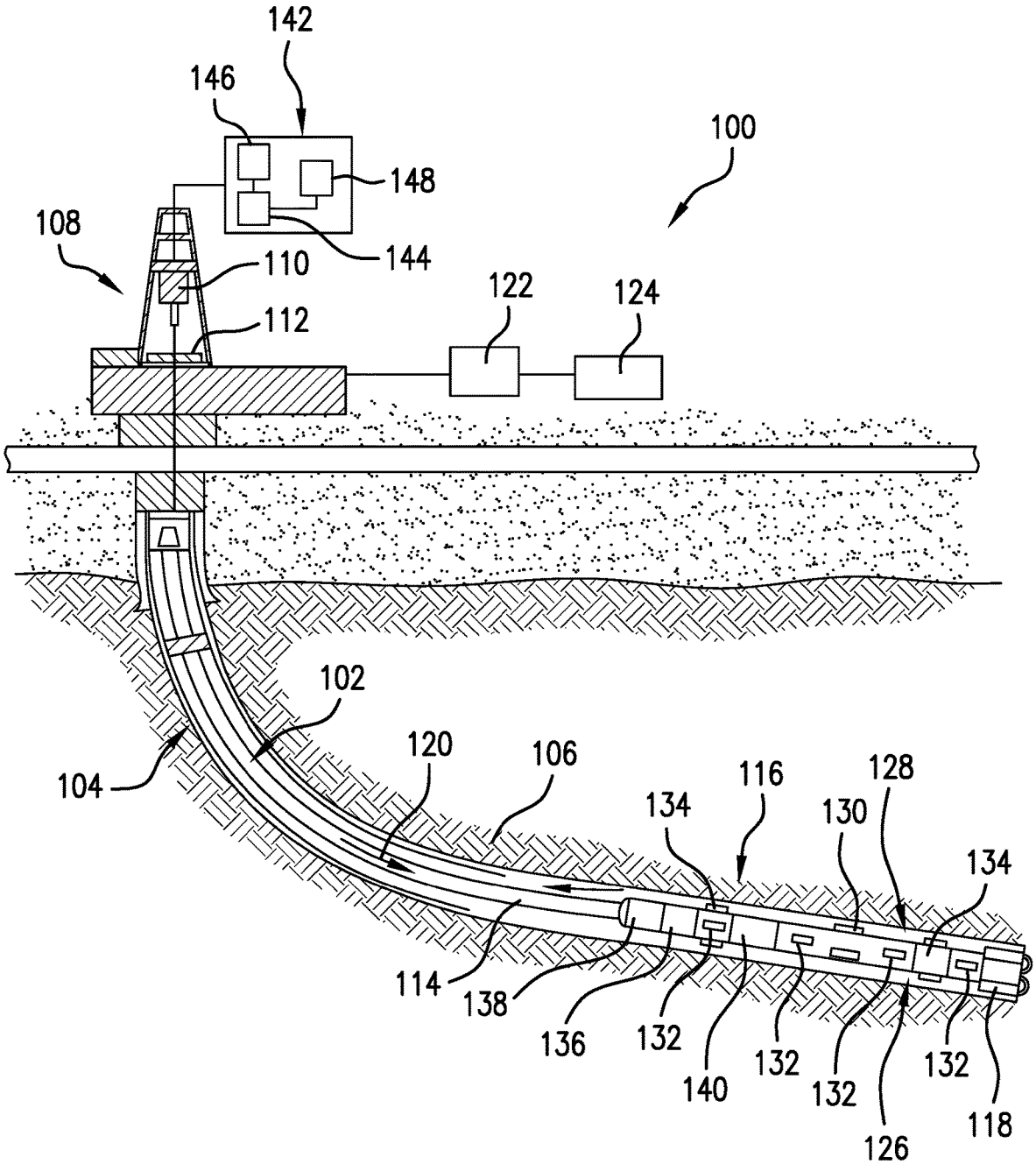
FIG. 1 depicts a schematic illustration of a wellbore operation system that can incorporate embodiments of the present disclosure.

FIG. 1 illustrates an embodiment of a system 100 for performing an energy industry operation (e.g., subsurface drilling, measurement, stimulation, and/or production). The system 100 includes a borehole string 102 that is shown disposed in a well or borehole 104 that penetrates at least one earth formation 106 during a drilling or other downhole operation. As described herein, "borehole" or "wellbore" refers to a hole that makes up all or part of a drilled well. It is noted that the borehole 104 may include vertical, deviated, and/or horizontal sections, and may follow any suitable or desired path. As described herein, "formations" refer to the various features and materials (e.g., geological material) that may be encountered in a subsurface environment (e.g., surrounding the borehole 104 and the material removed during drilling).

The borehole string 102 is operably connected to a surface structure or surface equipment such as a drill rig 108, which includes or is connected to various components such as a surface drive 110 (also referred to as top drive) and/or rotary table 112 for supporting the borehole string 102, rotating the borehole string 102, and lowering string sections or other downhole components into the borehole 104. In one embodiment, the borehole string 102 is a drill string including one or more drill pipe sections 114 that extend downward into the borehole 104 and is connected to one or more downhole components (downhole tools), which may be configured as a bottomhole assembly (BHA) 116. The BHA 116 may be fixedly connected to the borehole string 102 such that rotation of the borehole string 102 causes rotation of the BIA 116, The BHA 116 may be substantially cylindrical in shape and may have an outer diameter dimension and an outer diameter surface that may be exposed to downhole environments and materials (e.g., drilling fluids). The borehole string may also be referred to herein as a downhole string.

The BHA 116 includes a disintegrating device 118 (e.g., a drill bit), which in this embodiment is driven from the surface, but may be driven from downhole (e.g., by a downhole mud motor). The system 100 may include components to facilitate circulating fluid 120, such as drilling mud, through an inner bore of the borehole string 102 and an annulus between the borehole string 102 and a wall of the borehole 104. The inner bore of the borehole string 102 may be fluidly coupled to an inner bore defined within the BHA 116. The inner bore of the BHA 116 may be, in some configurations, a continuation of the inner bore of the borehole string 102. The inner bore of the BHA 116 may be defined by an inner diameter surface that has an inner diameter dimension. Further, in this illustrative embodiment, a pumping device 122 is located at the surface to circulate the fluid 120 from a mud pit or other fluid source 124 into the borehole 104 as the disintegrating device 118 is rotated (e.g., by rotation of the borehole string 102 and/or a downhole motor), with the fluid 120 passing through the inner bore of the borehole string 102 and the inner bore of the BHA 116.

In the illustrative embodiment shown in FIG. 1, the system 100 includes a steering assembly 126 configured to steer or direct a section of the borehole string 102 and the disintegrating device 118 along a selected path. The steering assembly 126 may have any configuration suitable to direct or steer the drill string 102. Examples of steering assemblies include, without limitation, steerable motor assemblies (e.g., bent housing motor assemblies), whipstocks, turbines, and rotary steerable systems ("RSS").

In one non-limiting embodiment, the steering assembly 126 is configured as a rotary steering assembly forming the BHA 116 or part of the BHA 116. The steering assembly 126 includes a rotary steerable system (RSS) that, in this embodiment, includes a non-rotating or slowly-rotating sleeve 128 that has one or more radially extendable pads 130 that may be extendable in a direction perpendicular to a longitudinal axis of the sleeve 128. The pads 130 may be located at different circumferential locations on the sleeve 128 and are adjustable individually or in combination to deflect the disintegrating device 118 by engaging the wall of the borehole 104.

The system 100 may also include a controller configured to operate or control operation of the pads 130 based on directional information derived from directional sensors located in the BHA 116 and/or the borehole string 102. The directional sensor(s) may be arranged at, in, or near the steering assembly 126. The directional sensor(s) can include one or more gyroscopes (e.g., gyroscope sensors or earth rate sensor sensors), and also include one or more magnetometers (i.e., magnetic field sensors) and/or one or more accelerometers (e.g., acceleration sensors and/or gravitational sensors).

In one embodiment, the system 100 includes one or more sensor assemblies 132 configured to perform measurements of parameters related to position and/or direction of the borehole string 102, the disintegrating device 118, and/or the steering assembly 126. As shown in FIG. 1, the sensor assemblies 132 may be located at one or more of various locations, such as on the sleeve 128, at or near the disintegrating device 118, and/or on other components of the borehole string 102 and/or the BHA 116. For example, a sensor assembly 132 can be located on one or more stabilizer sections 134 of the steering assembly 126. The sleeve 128 may be coupled to the borehole string 102 by a bearing assembly or other mechanism that allows rotation of the sleeve independent of the rotation of the borehole string, as will be appreciated by those of skill in the art. The sensor assembly 132 can include one or more sensors that may be synchronized at different frequencies (e.g., 1000 Hz, in time steps of 5 seconds, etc.) and with different tolerances with respect to the accuracy of a time deviation.

The system 100 may include one or more of various tools or components configured to perform selected functions downhole such as performing downhole measurements/surveys (e.g., formation evaluation measurements, directional measurements, etc.), facilitating communications (e.g., mud pulser, wired pipe communication sub, etc.), providing electrical power and others (e.g., mud turbine, generator, battery, data storage device, processor device, modem device, hydraulic device, etc.). For example, the steering assembly 126 can be connected to one or more sensor devices, such as a gamma ray imaging tool 136. Such gamma ray imaging tool 136 may be used to measure formation density, for example.

In one embodiment, the system 100 includes a measurement device such as a logging while drilling (LWD) tool (e.g., for formation evaluation measurements) or a measurement while drilling (MWD) tool (e.g., for directional measurements), generally referred to as while-drilling tool 138. LWD tools may include, for example and without limitation, LWD sensors and MWD tools may include, for example and without limitation, MWD sensors. Examples of LWD tools include nuclear magnetic resonance (NMR) tools, resistivity tools, gamma (density) tools, pulsed neutron tools, acoustic tools, and various others, Examples of MWD tools include tools measuring pressure, temperature, or directional data (e.g., magnetometer, accelerometer, gyroscope, etc.). The steering assembly 126 or the system 100 can include other components, such as a telemetry assembly (e.g., mud pulser, wired pipe communication sub, etc.) or other downhole and/or surface components, systems, or assemblies. The LWD tools and/or LWD sensors may be referred to herein as formation evaluation tools and/or formation evaluation sensors.

In one non-limiting embodiment, during drilling, the sleeve 128 does not rotate or rotates at a rate that is less than the rotational rate of the disintegrating device 118 and other components of the steering assembly 126 and rotary table 112 or surface drive 110. The rate of rotation of the sleeve 128 may be denoted herein as "slow rotation." It is noted that "slow" rotation is intended to indicate a rotational rate that is less than the drilling rotational rate and is not intended to be limiting to any specific rate. A "slowly-rotating" sleeve is a sleeve that rotates at the slow rotation rate.

The sleeve 128 can rotate at any suitable slow rotation rate that is less than the drilling rotation rate. In one embodiment, slow rotation of the sleeve 128 is a rate between about 1 and 10 revolutions per hour (RPH). In one embodiment, slow rotation is between about 10 and 50 RPH (60°/minute and 300°/minute). In yet another embodiment, slow rotation is about 1 and 50 RPH (6°/minute and 300°/minute).

One or more downhole components and/or one or more surface components may be in communication with and/or controlled by a processor such as a downhole processing unit 140 and/or a surface processing unit 142. The downhole processing 140 may be parts of the BHA 116 or may be otherwise arranged on or part of or disposed on the borehole string 102. The surface processing unit 142 (and/or the downhole processing unit 140) may be configured to perform functions such as controlling drilling and steering, controlling the flow rate and pressure of the fluid 120, controlling weight on bit (WOB), controlling rotary speed (RPM) of the rotary table 112 or the surface drive 110, transmitting and receiving data, processing measurement data, and/or monitoring operations of the system 100. The surface processing unit 142, in some embodiments, includes an input/output (V/O) device 144 (such as a keyboard and a monitor), a processor 146, and a data storage device 148 (e.g., memory, computer-readable media, etc.) for storing data, models, and/or computer programs or software that cause the processor to perform aspects of methods and processes described herein.

In one non-limiting embodiment, the surface processing unit 142 is configured as a surface control unit which controls various parameters such as rotary speed, weight-on-bit, fluid flow parameters (e.g., pressure and flow rate), and other parameters or aspects of the system 100. The downhole processing unit 140, in some embodiments, may be a directional measurement controller or other processing device that controls aspects of operating the sensor assemblies 132, acquiring measurement data, and/or estimating directional parameters. The downhole processing unit 140 may also include functionality for controlling operation of the steering assembly 126 and/or other downhole components, assemblies, or systems. In one non-limiting embodiment, the method and processes described herein may be performed in the downhole processing unit 140 located within the borehole string 102 or the BHA 116.

In the embodiment of FIG. 1, the system 100 is configured to perform a drilling operation and a downhole measurement operation, and the borehole string 102 is a drill string. However, embodiments described herein are not so limited and may have any configuration suitable for performing an energy industry operation that includes or can benefit from directional measurements (e.g., completion operation, fracturing operation, production operation, re-entry operation, etc.).

Figure 2:
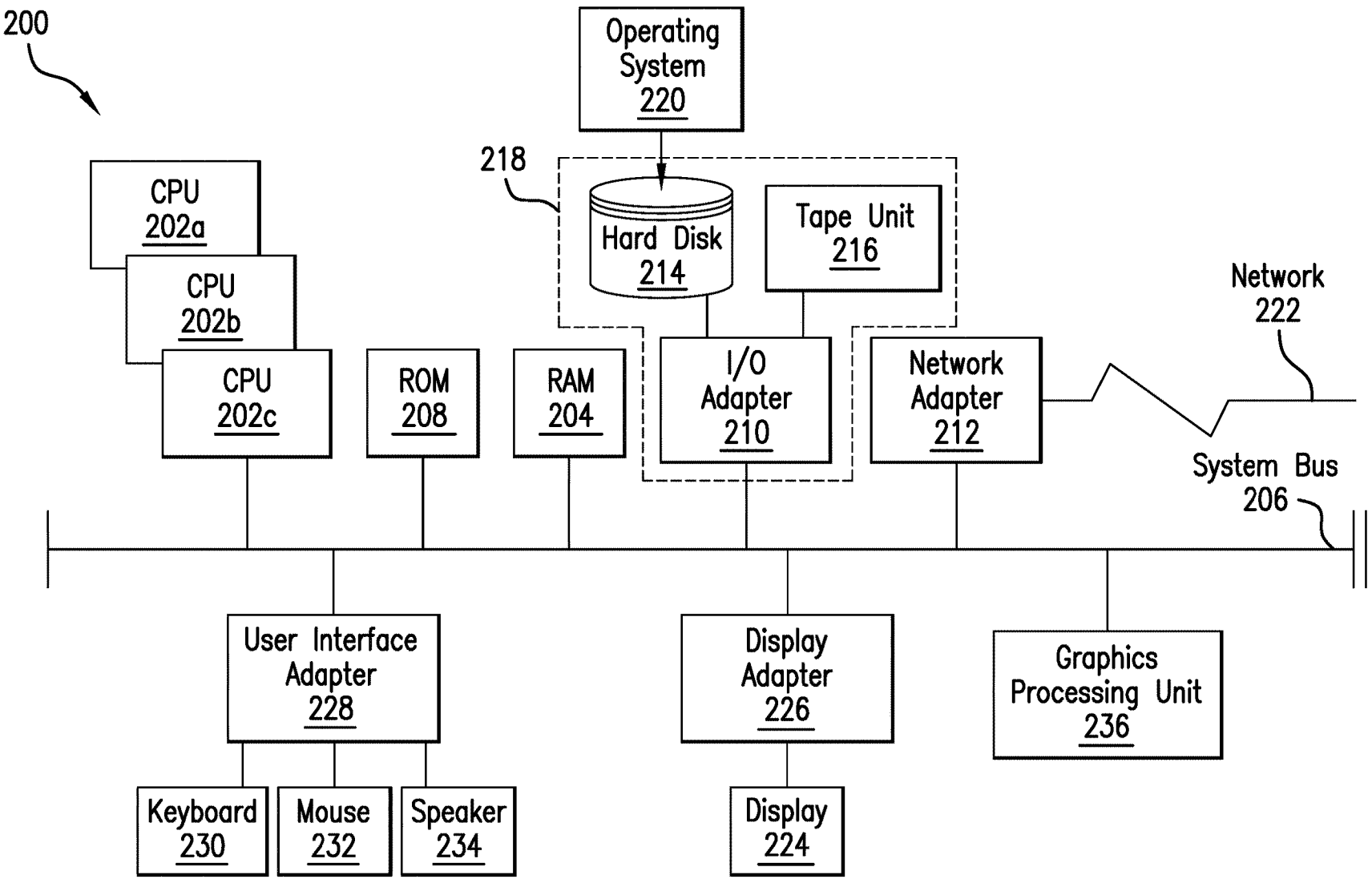
FIG. 2 depicts a block diagram of a processing system, which can be used for implementing more embodiments of the present disclosure.

It is understood that embodiments of the present disclosure are capable of being implemented in conjunction with any other suitable type of computing environment now known or later developed. For example, FIG. 2 depicts a block diagram of a processing system 200 (e.g., surface processing unit 142 and/or downhole processing unit 140 of FIG. 1), which can be used for implementing the techniques described herein. In examples, the processing system 200 has one or more central processing units 202*a*, 202*b*, 202*c*, etc. (collectively or generically referred to as processor(s) 202 and/or as processing device(s) 202). In aspects of the present disclosure, each processor 202 can include a reduced instruction set computer (RISC) microprocessor. The processor(s) 202, as shown, are coupled to system memory (e.g., random access memory (RAM) 204) and various other components via a system bus 206. Read only memory (ROM) 208 is coupled to the system bus 206 and can include a basic input/output system (BIOS), which controls certain basic functions of the processing system 200.

Further illustrated in FIG. 2 are an input/output (110) adapter 210 and a network adapter 212 coupled to the system bus 206. The I/O adapter 210 can be a small computer system interface (SCSI) adapter that communicates with a memory, such as a hard disk 214 and/or a tape storage drive 216 or any other similar component(s). The I/O adapter 210 and associated memory, such as the hard disk 214 and/or the tape storage device 216, may be collectively referred to herein as a mass storage 218. An operating system 220 for execution on the processing system 200 can be stored in the mass storage 218. The network adapter 212 may be configured to interconnect the system bus 206 with an outside network 222 enabling the processing system 200 to communicate with other systems and/or remote systems (e.g., internet, extranet, and/or cloud-based systems).

A display (e.g., a display monitor) 224 is connected to the system bus 206 by a display adaptor 226, which can include, for example, a graphics adapter to improve the performance of graphics intensive applications and a video controller. In one aspect of the present disclosure, the adapters 210, 212, and/or 226 can be connected to one or more I/O busses that are connected to system bus 206 via an intermediate bus bridge (not shown), as will be appreciated by those of skill in the art. Suitable I/O buses for connecting peripheral devices such as hard disk controllers, network adapters, and graphics adapters typically include common protocols, such as the Peripheral Component Interconnect (PCI). Additional input/output devices are shown connected to the system bus 206 via a user interface adapter 228 and the display adapter 226. For example, as shown, a keyboard 230, a mouse 232, and speaker 234 can be interconnected to the system bus 206 via the user interface adapter 228, which can include, for example, a Super U/O chip integrating multiple device adapters into a single integrated circuit.

In some aspects of the present disclosure, and as shown, the processing system 200 includes a graphics processing unit 236, Graphics processing unit 236 may be a specialized electronic circuit designed to manipulate and alter memory to accelerate the creation of images in a frame buffer intended for output to a display (e.g., display 224). In general, the graphics processing unit 236 is very efficient at manipulating computer graphics and image processing and has a highly parallel structure that makes it more effective than general-purpose CPUs for algorithms where processing of large blocks of data is done in parallel.

Thus, as configured herein, the processing system 200 includes processing capability in the form of processors 202, storage capability including system memory (e.g., RAM 204 and mass storage 218), input means such as keyboard 230 and mouse 232, and output capability including speaker 234 and display 224. In some aspects of the present disclosure, a portion of system memory (e.g., RAM 204 and mass storage 218) may be configured to collectively store an operating system (e.g., operating system 220) to coordinate the functions of the various components shown in the processing system 200.

It will be appreciated that the processing system 200 of FIG. 2 is presently described as a surface system (e.g., surface processing unit 142 of FIG. 1). However, it will be appreciated that similar electronic components may be employed in downhole systems (e.g., as part of a BHA and/or downhole processing unit 140), In such configurations, certain features of the processing system may be omitted. For example, in a downhole BHA system, the user interface components may be omitted. Further, the system bus may be arranged to span multiple different downhole components and the network connection may be a communication means (e.g., telemetry, wired connection, wireless connection, or the like) that is configuration to enable communication between a surface system and the downhole BHA system.

Formation evaluation (FE), during drilling, is typically performed using one or more sensors, such as those described above, for monitoring the formation through which a borehole is being drilled. However, as illustratively shown in FIG. 1, the sensors and sensor assemblies (e.g., elements 132, 136 shown in FIG. 1) are uphole from the disintegrating device (element 118). That is, there is a physical distance between the disintegrating device that is cutting through the formation and the sensors that are positioned and arranged to monitor, study, and evaluate the formation. As a result, it is difficult or impossible to accurately determine the specific properties of the formation being drilled through, at the time (instant) of drilling. That is, there is a lag between the location of the disintegrating device in operation and the sensors and detectors that monitor the formation. For example, during a drilling operation, it may be important to know when a formation changes from one to another, with the change potentially being indicative of a production formation. The delay between the disintegrating device position and the sensor(s) position may impact when a corrective or other drilling action is taken (e.g., instructing to transition from vertical drilling to horizontal drilling to maximum production in a formation).

In accordance with embodiments of the present disclosure, systems and processes for more quickly and timely determining formation changes, number of formations, and/or formation properties (collectively "formation properties") during a drilling operation are provided. In some embodiments, systems and processes that can rapidly determine formation properties from the drilling operation itself are provided. For example, in accordance with some embodiments of the present disclosure, the BHA or other downhole system may be arranged with one or more dynamics information sensors that are configured to monitor vibrations (e.g., torsional, axial, lateral), oscillations, tangential accelerations, axial accelerations, radial accelerations, dynamic torsional torque, dynamic weight on bit, rotary speed, rotary speed fluctuations, and other properties or characteristics in the BHA or other downhole system, such as due to the drilling operation. These properties and characteristics of drilling may be referred to herein as "dynamics information." The dynamics information sensors may be disposed along a BHA, in or at the disintegrating device or bit, or even at locations separated from the disintegrating device orbit. Through analysis of the signals obtained from the dynamics information sensors (e.g., dynamics information signals), a controller may be able to determine formation properties without the need for more complex sensors that may be positioned remote or separated from the disintegrating device or bit. As used herein, remote refers to a location along a longitudinal axis of the borehole string. In accordance with some non-limiting embodiments, a distance between a dynamics information sensor and a disintegrating device at an end of a string may be between 0.5 m and 1 m, 0.5 m and 3 m, 0.5 m to 10 m, 0.5 m to 20 in, or 0.5 to 40 m. In some embodiments, the distance between a dynamics information sensor and a disintegrating device may be greater than 0.5 m.

When analyzing the dynamics information, additional information (e.g., non-dynamic information) may be employed. For example, non-dynamic information may be used for reference and analysis of operational parameter influence. Such non-dynamic information may include, without limitation, static loads (e.g., normal force as an approximation of the WOB at a sensor position), bending moment, bending toolface, torque at a position of a sensor as an approximation of the static drilling torque, flow rate, average rotary speed, mud properties, cuttings properties, and the like. Additional or other static, non-dynamic, and/or dynamic information may be incorporated into embodiments of the present disclosure without departing from the scope thereof.

In operation, when a disintegrating device or other drill bit (hereinafter referred to as "bit") is cutting into and through a formation to form a borehole, force is applied to the bit which is rotated and operated to cut/grind/break the formation material to drill a borehole. The interaction of the bit with the formation causes vibrations to be induced in the bit, the 131-IA, and the string itself. The vibrations will propagate along the string in a direction uphole from the bit. These vibrations, in part, are the reason for placing conventional formation evaluation tools (FE tools) and sensors at a location separated from the bit by some minimum distance. That is, the vibrations caused by the drilling may interfere with accurate measurements obtained from various formation evaluation sensors, and thus the sensors may be placed away from the bit to avoid such interference. Further, the BHA and specifically the tool configuration around the bit may not be able to accommodate complex sensors or sensor assemblies, and thus it may be difficult to incorporate such sensors close to the bit.

Embodiments of the present disclosure are directed to techniques for performing formation evaluation through monitoring of vibrations or dynamics information induced in the BHA, string, and tool sections of the downhole system. By monitoring the vibrations at the bit or at a location remote from the bit, it may be possible to determine formation properties without waiting for the delay associated with sensors that are remote from the bit and are required to travel additional distance to reach the same location as the bit (relative to the formation). That is, these other sensors are at fixed positions and only reach the location of the bit at a time later than the bit, as the hole must be drilled for the sensors to travel to the same position as the bit when it was drilling. In the time it takes for an FE tool to reach the formation that was drilled earlier by the bit/disintegrating device, the formation may be subjected to alterations caused by environmental conditions or other factors/impacts. For example, borehole fluid in the borehole will affect and alter properties near the borehole wall. The borehole fluid may enter or permeate into the formation, which may result in the borehole fluid replacing pristine formation fluids (e.g., water, gas, oil, etc.) and/or may alter the original pore structure and/or porosity of the formation around the borehole. Typically, FE tools are arranged more than 10 m away from the bit/disintegrating device. At a rate of penetration (ROP) of 30 m per hour, an FE sensor located 10 m from the bit (i.e., uphole from the bit) will reach a formation location about 20 minutes after the location was drilled through by the bit. Similarly, an FE tool located 20 m from the bit will require 40 minutes to reach the drilled location, and an FE tool located 30 m from the bit will require an hour to reach the drilled location. As such, there is time for the borehole fluid or other impacts to change or alter the formation at the borehole wall. By employing dynamics information sensors, which monitor vibrations of the BHA itself, directly monitoring of the formation by FE sensors is not required.

Figure 3:
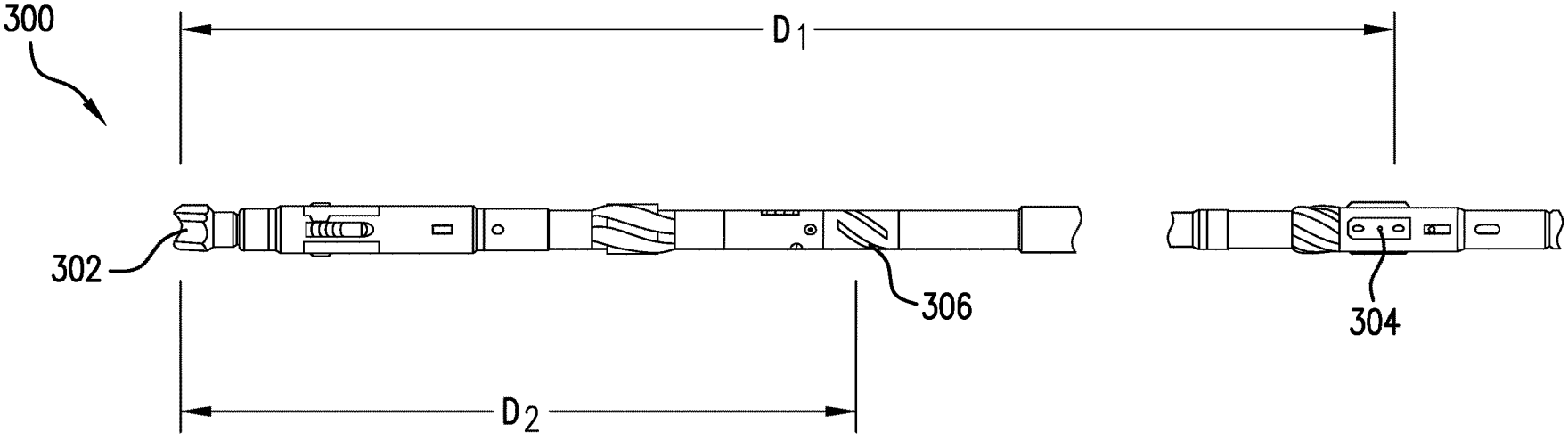
FIG. 3 is a schematic illustration of a portion of a downhole string in accordance with an embodiment of the present disclosure.

Referring now to FIG. 3, a schematic illustration of a portion of a bottom hole assembly (BHA) 300 is shown in accordance with an embodiment of the present disclosure. The BHA 300 may be part of a subsurface formation drilling system, which may be rotationally driven or otherwise controlled from a surface location (e.g., as shown in FIG. 1). The BHA 300 includes, in this illustration, a bit 302 at an end of the BHA 300, with a rotary steerable system 301, a stabilizer 303, a formation evaluation sensor 304, and a dynamics information sensor 306 arranged along a length of the BHA 300. The bit 302 is configured to be driven to disintegrate, break, or otherwise cut into a formation to drill a borehole therethrough. The bit 302 is arranged at an end of the BHA 300, and other components are disposed uphole from the bit 302. As shown, the formation evaluation sensor 304 may be arranged at a first distance $D_1$ along a longitudinal axis A of the BHA 300 from the bit 302 and the dynamics information sensor 306 may be arranged at a second distance $D_2$ from the bit 302 along the longitudinal axis A of the BHA 300.

The formation evaluation sensor 304 may be a sensor, sensor assembly, sensor sub, or the like that is configured to obtain information regarding a formation that is being drilled through. The formation evaluation sensor 304 can include, without limitation, nuclear magnetic resonance (NMR) tools, resistivity tools, gamma (density) tools, pulsed neutron tools, acoustic tools, and the like. Formation evaluation sensors provide data that allow for the determination of formation properties, such as formation type, formation porosity, formation permeability, formation density, formation fluid type, formation resistivity, and the like. These types of sensors may be sensitive to interference that is caused by vibrations or signals or interactions between the bit 302 and the formation or may not reasonably be placed closer to the bit due to various constraints on BHA assembly requirements (e.g., inclusion of non-sensor modules related to steering, drilling, placement, etc.). Accordingly, the formation evaluation sensor 304 is typically positioned an appropriate distance from the bit 302 to avoid such interference. However, as noted above, this results in the formation evaluation sensor 304 being the first distance $D_1$ from the bit 302, which results in a lag between when the bit 302 drills through a section of a downhole formation and when the formation evaluation sensor 304 can interrogate the same section.

In contrast, the dynamics information sensor 306 may be positioned closer to the bit 302 than the formation evaluation sensor 304. This is due, in part, to the fact that the dynamics information sensor 306 is configured to monitor a property of the BHA 300, and not specifically or directly the formation itself. As such, the distance between the dynamics information sensor 306 and the bit 302 is not as important (in terms of interference). Further, because vibration and other dynamics information sensors 306 may be simpler (e.g., no required generation of a signal that is directed into the formation), the sensors may be located at non-traditional locations, such as within the bit itself. That is, in some embodiments, it may be advantageous to position the dynamics information sensor 306 as close to the bit 302 along the BHA 300, and even in some embodiments incorporate the dynamics information sensor 306 directly into the bit 302 (e.g., sensors in the blades or cutting tools of the bit). In accordance with some embodiments, there may be more than one information dynamics sensor in the BHA to monitor dynamics information at different locations along the BHA. Such additional information dynamics sensors may be beneficial, for example, to account for vibration modes that are induced in the BHA due to the formation cutting process (i.e., drilling), and such modes may include amplitudes that are dependent upon axial or longitudinal position along the BHA.

Further, in some embodiments, the distance between one or more of the dynamics information sensors and the bit may be greater than the first distance $D_1$. That is, in some embodiments, the dynamics information sensors 306 may be arranged at positions that are farther from the bit 302 than the formation evaluation sensor 304. These dynamics information sensors 306 that are farther from the bit than the other sensors may still provide fast detection due to propagation of the vibration through the BHA, and does not require a specific or special placement on the BHA or relative to the formation. The propagation of the vibration information through the string will typically significantly faster than the drilling rate, and thus these dynamics information sensors 306 may provide advanced knowledge of a formation property (e.g., change) as compared to conventional formation evaluation sensors. The propagation of vibrational modes along the borehole string may typically occur in a time frame range that is less than one second. For example, and without limitation, the propagation of a vibration mode from the bit to a given dynamics information sensor 306 may be between 0.001 s and 0.01 s, 0.01 s and 0.1 s, 0.01 s and 0.1 s, or 0.1 s and 3 s.

A change in the dynamics measurements due to a formation property (e.g., change in formation) may be instantaneous or within a few seconds of the formation change. In contrast, as noted above, the formation evaluation measurements (e.g., at formation evaluation sensor 304) are typically in tools several meters above the bit. This offset distance between where the bit is located and the position of the sensor needs to be drilled until the formation can be detected by the formation evaluation tool (e.g., formation evaluation sensor 304). As noted above, depending on the separation distance between the bit and the formation evaluation sensor 304, and the rate of penetration (ROP), may be half an hour or longer in time.

The dynamics information sensor 306 is configured to measure or monitor vibrations that are experienced by the BHA 300. To this end, the dynamics information sensor 306 may comprise a single sensor, a collection of separate sensors, an array of sensors, or the like. In some embodiments, a number of sensor elements may be distributed along an axial or longitudinal length (e.g., along the longitudinal axis A) or section of the BHA 300 or the string associated therewith. Further, the radial and/or circumferential position(s) of such sensors may be selected for desired purposes (e.g., direction a sensor is pointing within a coordinate system or the like). Accordingly, the dynamics information sensor 306 may detect tangential or torsional vibration, lateral vibration, and/or axial vibration. The tangential direction refers to a direction along a circumference of the BHA and perpendicular to the longitudinal axis A of the BHA. The lateral direction refers to a radial direction perpendicular to the longitudinal axis A of the BHA. The axial direction refers to a direction parallel to the longitudinal axis A of the BHA.

The dynamics information sensor 306 may include one or more of strain gauges, accelerometers, eddy-current sensors, laser displacement sensors, gyroscopes, microphones, vibration meters, velocity sensors, proximity sensors, earth magnetic field sensors (e.g., magnetometers), or the like. In accordance with some embodiments, the dynamics information sensors 306 located in different tools along the BHA maybe be synchronized (e.g., with a high accuracy with respect to a sampling frequency in one tool, between different tools through a bus system used for communication between tools and/or sensors, etc.). In some embodiments, the sensors may be synchronized by a signal between different tools, at a certain time scale (e.g., in 5 second steps where the data shall be sampled and averaged in the same time window), and with a certain accuracy with respect to the synchronization. The accuracy may be a fraction of the time window where the data is averaged (e.g., a hundredth or a tenth of a second in a case of averaged data in a 5 second data time window). Further, for example, if the sensors are synchronized at 1000 Hz (e.g. within a tool) and sample at 1000 Hz, a fraction of the time between two of the samples where the synchronization may be beneficial to evaluate the phase between the signals which gives additional modeling insights and information for interpretation.

Through monitoring of dynamics information data, a data-driven estimation of the composition of the formation may be achieved using dynamics information data as described herein. A dynamics (e.g., vibration) information signature excited by a bit-rock interaction is strongly dependent on the mechanical properties of the formation (e.g., dependent on rock type, rock composition, and/or a dip of the formation being drilled through by the bit). A considerable time advantage of dynamics information measurements, as compared to formation evaluation measurements, is achieved through implementation of embodiments described herein. The time advantage is not merely with respect to time savings of data acquisition, but also related to providing improved time-to-decision when a change in formation is detected. However, merely knowing when a formation changes may be insufficient for all while-drilling purposes, although such information may be useful, such as when drilling through a known formation (e.g., knowledge from offset wells through the same formation).

Different formations have different mechanical properties. The bit-rock interaction depends on the bit, the formation type (e.g., strength, stress, etc.), the formation dip, the operational parameters (e.g., WOB or RPM), and the configuration of the BHA. The dynamics signatures excited by bit-rock interaction can be modeled and classified by a frequency spectrum of the excitation (operational parameter-stationary). The different mechanical properties of the formation can lead to an excitation of different dynamic signatures and spectra (vibration modes). The frequency spectrum of the excitation leads to vibrations in the BHA. The vibrations measured in the BHA are dependent on the transfer function from the point of excitation (e.g., at the bit) to the point of observation (e.g., at the dynamics information sensor) and the excited frequency spectrum. A formation-typical frequency spectrum can be calculated using a sensor response and a transfer function that is given by the mechanical properties of the BHA. Axial and torsional transfer functions (e.g., vibration modes/mode shapes/natural frequencies) do not significantly change by bit depth and are therefore wellbore-depth independent. The mechanical properties of the BHA depend on the configuration of the BHA. For example, and without limitation, the mechanical properties/factors may include the axial or longitudinal length of the BHA, the outer diameter dimension of the BHA, the inner diameter dimension of the BHA, the number of BHA components, the number of connections between BHA components, the type of BHA components (including stiffness and length of such components), the material properties of the BHA components, and the order of BHA components that form, make up, or otherwise define the BHA. It is noted that transfer functions are dependent upon the BHA configuration. As such, when the BHA changes, the transfer function will also change. Accordingly, a first BHA having a first BHA configuration will define a first transfer function, and a second BHA with a second BHA configuration different from the first BHA configuration will have a second transfer function that is different from the first transfer function.

Although BHA 300 is illustrative of an end of a drilling assembly or the like, it will be appreciated that the processes described herein may be implemented with a reamer bit, and thus the bit referred to herein may not be disposed on an end of the entire drilling system, but may be at the end of a section of the borehole string for performing reaming operations, such as an upper end of the BHA. The reamer is a disintegrating device or tool that is used to cut into a formation, and thus will be subject to reamer-formation interaction (e.g., bit-rock interaction). The system properties of a reamer configuration will be different than a string-end bit, but modeling and system-property information can be adjusted to the reamer configuration, and thus embodiments of the present disclosure may be used in reamer systems.

Figure 4:
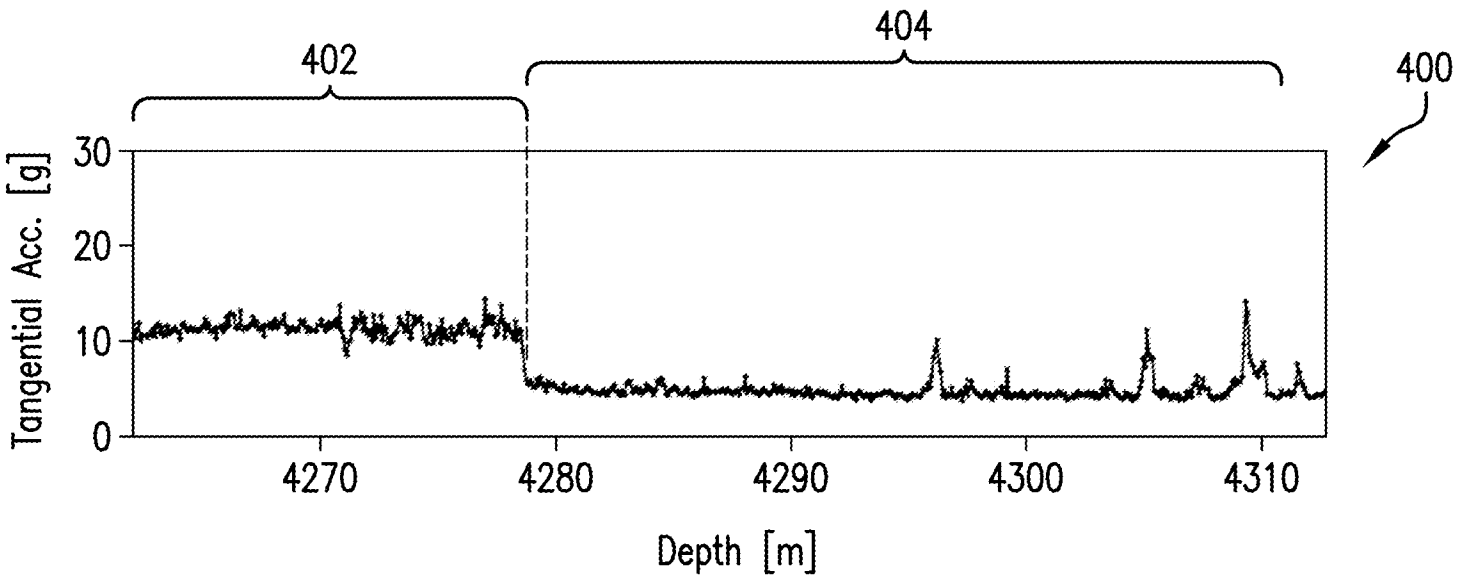
FIG. 4 is a schematic plot illustrating dynamics information as a function of depth.

Referring now to FIG. 4, a plot 400 of tangential acceleration (vibration) as a function of depth is schematically shown. Along the x-axis or horizontal axis is depth (in meters), indicative of a drilling process, with increasing depth indicating a deeper drilled well. The y-axis or vertical axis represents tangential acceleration (in g) that is measured in a BHA having a dynamics information sensor therein. Plot 400 illustrates the potential changes that may be experienced by a BHA drilling through a downhole formation. For example, as shown, a first region 402 is illustrative of the dynamics information or dynamics signature (e.g., dynamics information signature) through a sandstone formation and a second region 404 is illustrative of the dynamics information or dynamics signature (e.g., dynamics information signature) through a shale formation. As clearly indicated in plot 400, the amplitude of the signature significantly decreases at the sand-to-shale transition between the first region 402 and the second region 404. For example, in this non-limiting embodiment, the transition from sandstone to shale results in a reduction of almost 50% in amplitude of the dynamics information (e.g., from about 10 g to about 5 g). From this abrupt change in dynamics information (e.g., amplitude change), it may be determined that the formation has changed. If the drilling is through a known formation, the dynamics information provides indication that a change in formation has occurred, which may assist in transitioning from a vertical drilling operation to a horizontal drilling operation. Although FIG. 4 is discussed with respect to an amplitude of tangential acceleration, amplitudes of force or other measurable properties may be employed without departing from the scope of the present disclosure, such as lateral acceleration or axial acceleration.

In some embodiments, the knowledge of a change in formation may be sufficient for drilling purposes (e.g., through known formations or when tracking against a specific well plan or the like). Thus, in some embodiments, the dynamics information sensors may be used to monitor for changes in dynamics information signatures or signals. If it is desired to know more information regarding the formation being drilled through, in some embodiments, the formation evaluation sensors that are farther from the bit may be used, when they are appropriately positioned (e.g., later in time). In such a case, the formation evaluation sensors may be used to confirm, validate, calibrate, or add upon the information/change detected by the dynamics information sensors at the time the bit drills through a particular formation or downhole structure. In accordance with some embodiments, the sequence of different formation types along an increasing measured depth (MD) or true vertical depth (TVD) may be known from an offset well, which may be determined using formation evaluation sensors in the BHA used to drill the offset well. The known sequence allows for detection of specific formation types in the sequence by observing formation changes in the dynamics information signatures.

However, it may be advantageous to determine formation properties at the time the new formation is entered by the drill bit. That is, it may be advantageous to make such determination before the formation evaluation sensor enters the location of the formation of interest (e.g., typically 30 minutes or longer after the drill bit drills through the formation of interest). The dynamics information sensors can provide instantaneous or near-instantaneous measurement in response to the BHA/string changing the formation that is being drilled. That is, when formation properties change (e.g., from one rock type to another), the dynamics information will change, and the vibrations, oscillations, strains, and other dynamics information will be altered as a result of the bit entering in and interacting with the new formation material(s). The change in dynamics information is a result of the bit interacting with different formation materials. Instantaneous or near-instantaneous, as used herein, refers to the time the disintegrating device is drilling a specific formation. The dynamic information provides information of the formation that is at the location where the disintegration device is drilling at the time of the dynamic information measurement.

Although FIG. 4 illustrates the primary difference between the formations as amplitude, the dynamics information is not limited to amplitude. Different formation types may exhibit different variations related to amplitude, frequency, spectral density, repeating patterns, peak values, minimum values, continuity, or the like. That is, each type of rock formation may exhibit different properties that will manifest as different dynamics information signatures as detected by dynamics information sensors. Further, the specific configuration of the BHA will impact the nature of the induced vibrations and the like, and thus a tool-specific correlation may be required. For example, different types of bits may interact with different formations differently. Additionally, total weight, weight-on-bit (WOB), rate of penetration (ROP), types of components and subs attached and assembled in the BHA, the properties of such components/subs (e.g., mechanical properties, material properties), order of components/subs in the BHA, etc., may all impact the induced vibrations that are detected by the dynamics information sensors.

In accordance with some embodiments, a transfer function is employed to take information obtained at the dynamics information sensors and calculate a formation property. The transfer function may be based, in part, on the BHA configuration, such as the mechanical properties of the BHA or other tools (e.g., BHA components), including without limitation, other sections of BHA or tool and/or drill string sections. The transfer function can be modeled by an analytical, semi-analytical, numerical, or other dynamic model of the drilling system. Such models can include boundary conditions that represent an interaction of a stabilizer or other part of the BHA with the formation, the top drive contact to the drilling system, or other boundary conditions as will be appreciated by those of skill in the art.

In accordance with embodiments of the present disclosure, a numerical model is used to calculate a dynamic response of the system (e.g., response to forces). In accordance with some embodiments, material properties and geometry of the drilling system (BHA configuration) and properties that influence damping (e.g., normal forces and friction coefficients in frictional contacts such as thread connections and frictional contacts between the BHA and the borehole wall), mud properties, properties of fluids within the system, and the like may be employed. The damping can be approximated by a constant damping for a vibration mode or with respect to a force acting with the drilling system. The damping can be estimated from measurement in the laboratory or from downhole data using (operational) modal analysis methods or similar methods (damping constant). The transfer function can be calculated from the system response (dynamic response) of such a model, such as by performing a modal analysis. The transfer function is then a function of the modal properties of the point of interest where the drill bit is interacting with the formation and the point of interest where the dynamics information sensor is located. The information used for this purpose is the amplitudes (e.g., displacement, velocity, acceleration) of the mode shapes that maybe mass normalized or normalized to a different property, the natural frequency or the angular natural frequency (with damping considered or damping neglected), and modal damping values or other representation of the damping such as Rayleigh damping (mass or stiffness matrix proportional damping, structural damping, etc.). The transfer function can be calculated by means of an equation of motion of the system including a mass matrix, a stiffness matrix, and a damping matrix of the system and any forces that may influence these kinds of properties (e.g., nonlinear friction forces, wall contact forces, etc.). The transfer function can be calculated by using a ratio of the mode shape that is considered at the bit and at the dynamics information sensor which provides (on a stationary stage) the ratio of the amplitudes at the natural frequency of the underlying mode at that position (i.e., position of dynamics information sensor). Beneficial modes are axial and torsional modes because these typically only change minimally through an increase of the depth of the wellbore and the depth of the drilling system and therefore stay nearly constant throughout a drilling operation or run. Other methods to model the transfer function may be, without limitation, a Laplace transformation, a ratio or function of the autocorrelation which can be a function of a covariance and variance of a signal calculated from the model or calculated from a measurement (e.g., a modal analysis or any noise excited downhole).

The transfer function, as employed in embodiments of the present disclosure, may be a function that describes the transfer of a harmonic force or torque with an angular excitation frequency "omega" (w) acting at one position (e.g., position of the disintegration device) in a stationary process to an amplitude (e.g., displacement, velocity, acceleration) at another position of the system (e.g., position of the dynamics information sensor). Assuming a harmonic excitation with one frequency, the ratio of a force f and an amplitude x is given by:

$$H(\omega) = \alpha(\omega) = 1/(k - \omega^2 m + i\omega c) \tag{1}$$

Where H is a frequency response function, ω is the angular frequency, α is a frequency response function (transfer function), k is stiffness, m is discrete mass, i is a complex number, and c is the damping constant. Different representations that do not use the complex number (i.e., "i") exist, such as defining the absolute value of the transfer function and the phase between the excitation and the resulting amplitude. The absolute value:

$$|\alpha(\omega)| = \frac{|x|}{|f|}$$

relates the force f to the amplitude x with an harmonic excitation with the angular frequency ω. In the case of Equation (1), a lumped mass model is assumed with a discrete mass m, a spring stiffness k, and a damping constant c. Equation (1) can be used to calculate, with the knowledge of the transfer function α, the force f from the displacement x or vice versa. Instead of the displacement x, the velocity or the acceleration may be used to calculate the force f by using the transfer function. For example, and without limitation, the amplitude may also be related to other physical parameters, such as strain to monitor WOB and/or torque.

For example, the force that is applied to the bit can be calculated from the transfer function. The force is then assumed to be typical for a specific formation and bit configuration. The same can be done for multiple modes of a structure (BHA). The modes are typically determined by a modal analysis. The modal analysis can be done experimentally. For example, the transfer function can be determined by exciting a structure with a force at one point and measuring the amplitude of the force. For example, the force amplitude may be measured at the position where the force is applied and at another position of the structure that is separate or separated from the position where the force is applied (e.g., two positions on the BHA, which may be separated by a longitudinal distance), an amplitude of dynamic information may be measured (e.g., acceleration). With this information, the transfer function can be calculated and modal properties can be determined by typical experimental modal analysis techniques in the time or frequency domain.

In some embodiments, a modal analysis may be determined with an operational modal analysis where no external force is applied and the modal properties are determined from random excitation (e.g., during drilling or milling processes). In some embodiments, the modal properties may be determined from a numerical analysis, such as, and without limitation, a finite element model, a transfer function model, a discrete element model, a model that consists of multiple lumped masses, etc. The models can have the properties of mass, stiffness, and damping of the structure (e.g., BHA) and external forces that can be linear or nonlinear with respect to an amplitude.

Having the modal properties of a vibration mode, the transfer function can be determined with a mass matrix M, a stiffness matrix K, a damping matrix C, a vector of external forces f and a vector of amplitude x:

$$x = \left(K - \omega^2 M + i * \omega * C\right)^{-1} * f \tag{2}$$

In Equation (2), i indicates a complex number, the amplitude vector is x, the force vector is f, the angular frequency is ω, M is the mass matrix, K is the stiffness matrix, and C is the damping matrix. Typically, the modal analysis in case of a damped system is done by:

$$\begin{bmatrix} C & M \\ M & 0 \end{bmatrix} \cdot \dot{y} + \begin{bmatrix} K & 0 \\ 0 & -M \end{bmatrix} * y = 0 \tag{3}$$

In Equation (3), y and ẏ are the state vectors that contain the physical displacement amplitudes x and the physical velocity amplitudes ẋ, respectively. If a modal analysis is done, the transfer function can be directly expressed by means of modal parameters of the mode and a summation of those. The transfer matrix $\alpha_{jk}(\omega)$ and each entry of the matrix can be derived by:

$$\alpha_{jk}(\omega) = \sum_{r=1}^{N} \frac{(\phi_{jr} * \phi_{kr})}{\left(\omega_r^2 - \omega^2 + i\eta_r \omega_r^2\right)} \tag{4}$$

Where the excitation frequency is a, the natural frequency of the mode r is $\omega_r$, $\phi$ is the modal matrix containing the mode shapes or eigenvectors of the system, N is the number of modes, which is in the case of a discrete model (e.g., finite element model) is equal to the number of degrees of freedom of the model that are considered, j is one degree of freedom, k is another degree of freedom, and $\eta_r$ is a ratio of the excitation frequency and the natural frequency of mode r. The transfer matrix $\alpha_{jk}(\omega)$ describes how a force acting on a degree of freedom k leads to a displacement at another degree of freedom j. The response is derived by a summation of the response of all modes N. In some embodiments and configurations, certain modes may be ignored. For example, if the natural frequency $\omega_r$ is outside of the frequency range of interest or it is known that a specific mode will not be excited (e.g., has a close-to-zero amplitude of the mode shape at the point of excitation), then these modes may be ignored.

The above function(s) (transfer function), or similar functions, can be used to calculate an amplitude at one point of the structure from an amplitude at another point of the structure for an amplitude related to one or multiple modes or a response of the system to, for example, a harmonic force at the bit or a force out of an amplitude or modal amplitude at the bit. Similar methods can be used to derive a transfer function for or from a case with impulse or Dirac-like excitation or response or random vibration. In such a case, an autocorrelation function, a spectral density function of the signals, or an assumed random excitation are used to derive the transfer functions. The result of a modal analysis are the frequency and the mode shapes. For a stationary response, the ratio between a measurement of the amplitude at a certain natural frequency (e.g. separated by a Fast Fourier Transform (FFT)) can be related to the amplitude at another position simply by using the ratio between the amplitudes of both. This can be separately done for every mode and associated mode shape to calculate the amplitude at the bit. In some embodiments, the transfer function may relate an amplitude (e.g., displacement, velocity, acceleration) at a first position (e.g., dynamics information sensor) to an amplitude (e.g., displacement, velocity, acceleration) at a second position (e.g., bit). In some embodiments, the transfer function may relate an amplitude (e.g., displacement, velocity, acceleration) at a first position (e.g., dynamics information sensor) to a force at a second position (e.g., bit). In some embodiments, the transfer function may relate an amplitude (e.g., displacement, velocity, acceleration) at a first position (e.g., first dynamics information sensor) to an amplitude (e.g., displacement, velocity, acceleration) at a second position (e.g., second dynamics information sensor).

A power spectral density (PSD) that describes the power in discretized parts of the spectrum with a specific frequency width $\Delta f = f_2 - f_1$ can be used to describe the stationary power of the drilling process. It can be calculated by $PSD = \Sigma S_{xx}(\omega)/\Delta\omega$, wherein PSD represents the stationary power, $S_{xx}$ is the (auto) spectral density response, xx are indices describing that the spectral density response is related to the amplitude x (two similar indices denotes that it is an auto-spectral density response, whereas two different indices refers to a cross-spectral density response). The stationary power can be directly calculated if the drilling force or torque is measured, but such measurements are not typically conducted.

A state space model may be provided by:

$$\dot{y} = Ay + f(t) \tag{5}$$

wherein $\dot{y}$ is the first derivative of the state vector with respect to time (including the velocity amplitude and the acceleration amplitude), y is the state vector that includes the displacement amplitude and the velocity amplitude in one vector, f is the excitation force, t is a variable indicating a time, and A is a state space matrix having structure $$A = \begin{bmatrix} 0 & E \\ -M^{-1}K & -M^{-1}C \end{bmatrix}.$$

In the matrix A, E is a unity or identity matrix, M is a mass matrix, K is a stiffness matrix, and C is a damping matrix). A frequency response matrix (transfer matric) $G(\omega)=(i\omega E-A)^{-1}$, where E is the identity matrix, can be used to calculate the spectral density matrix of the response (spectral density response matrix). A signal that is measured by a downhole tool may have the form: $S_{xx}(\omega)\ G(\omega)S_{ff}(\omega)G^T(-\omega)$. Herein $S_{ff}(\omega)$ is the (auto) spectral density matrix of the assumable time invariant and linear process of the drilling force or torque. Similar method(s) could be used to approximate nonlinear processes, time variant processes, processes that are time invariant in a certain time window, or the like. A certain time interval [−T, T] is assumed where the processes $y^0(t)$ (amplitude over time at a sensor or other position) and $f^0(t)$ (force over time, e.g., at the bit) are regarded. These processes may represent the response and the excitation of a stochastic process that can be used to describe the dynamic part of the excitation through the bit. It is assumed that the stochastic process is zero outside this time interval to calculate the Fourier Transform of $$Y_T(\omega) = \frac{1}{2\pi}\int x^0(t)e^{-i\omega t}dt$$

and equivalent for $F_T(\omega)$ with argument $f^0(t)$. The equation $S_{xx}(\omega)=G(\omega)S_{ff}(\omega)G^T(-\omega)$ can be used based on this assumption to calculate $S_{xx}(\omega)$ from $G(\omega)$ (which can be derived from a numerical or analytical model of the dynamic response of the system) and $S_{ff}(\omega)$ which can be calculated by a Fourier analysis as described which could include a Fast Fourier Transform (FFT) of the force signal measured signal. It could be used to calculate the transfer matrix $G(\omega)$ from $S_{xx}(\omega)$ which is the spectral density response matrix of the response of the system and $S_{ff}(\omega)$ which is the spectral density matrix of the input (e.g., force, torque, etc.) to the structure, which is the excitation through a cutting structure (e.g., disintegrating device, bit) or another contact between the drilling system/BHA and the formation. The main use here is to calculate from the transfer matrix G (ω) derived from a numerical model and the spectral density response matrix $S_{xx}(\omega)$ of the stochastical process the spectral density matrix $S_{ff}(\omega)$ of the stochastical process of the drilling force or torque which is assumed to be characteristic for a formation which is drilled by a specific bit.

In accordance with some embodiments, the characteristics of the stochastical process are assumed to be reasonably constant over time if the drilling application does not change (which includes the formation itself). Therefore, the stochastic properties of the drilling force at the bit stay the same for a given formation. This means that the drilling forces can generally vary over time and vary in frequency content and/or amplitude if two different time samples are compared. The distribution function that describes this variation of the drilling forces, however, remains the same over time, as long as the formation properties remain the same. That means that the stochastic moments of this distribution, given two reasonably long time frames, remain the same. Stochastic moments are, for example, the mean value, the variance, the skewness, and the kurtosis, or higher order moments. In accordance with some embodiments, these moments and values that are derived in a similar manner and describe the process or the distribution of the force are assumed to be representative for a formation.

The transfer function (or matrix) may be dependent on the mechanical properties of the structure of the drilling system (inner and outer diameter of the BHA, BHA mass, outer diameter of components in the BHA, length of the BHA, material properties of the BHA (e.g., stiffness, tensile strength, etc.), number and position of components and/or connections in the BHA, etc.). These mechanical properties can be influenced by contacts with the borehole wall (often referred to as wall contacts) or mud properties or anything else which may influence the static or dynamic response of the system. The dynamic response can be calculated with respect to a static response or linearized with respect to a static response or the like. The spectral density matrix $S_{ff}(\omega)$ of the stochastical process at the cutting structure (for example) will be influenced by the mud properties and will mainly be influenced by the formation that is drilled and the bit that is used, along with the drilling parameters, such as the rotary speed (RPM) at the bit, the weight on the bit (WOB), and the torque on the bit. It can also be influenced by superimposed slower frequency types of vibrations (low frequency vibrations), which may be induced by the drilling process. It can be assumed that the spectral density matrix $S_{ff}(\omega)$ of the stochastical process is approximately constant in a certain state of a low frequency vibration which could, for example, be stick/slip. Stick/slip may influence lateral vibrations or torsional oscillations (such as high-frequency torsional oscillations) which are commonly known. Vibration levels will, for example, be different through different bit rotary speed values in a period of stick/slip. Some of these influence factors may be dominant and others may be negligible. The spectral density matrix $S_{ff}(\omega)$ may be referred to as equal with respect to certain parameters (e.g., when bits are similar/identical). Low frequency vibrations may include frequencies below a certain threshold. For example, low frequency vibrations may be below a few Hertz, such as below 1 Hz, or below 5 Hz, or the like. In contrast, torsional vibrations that are detected by the dynamics information sensors which provide the dynamics information signature used to identify formation properties includes frequencies above a minimum of threshold, such as 20 Hz. In some configurations, for example and without limitation, the threshold for torsional vibrations may be frequencies of 20 Hz or greater, 50 Hz or greater, or 100 Hz or greater.

Figure 5:
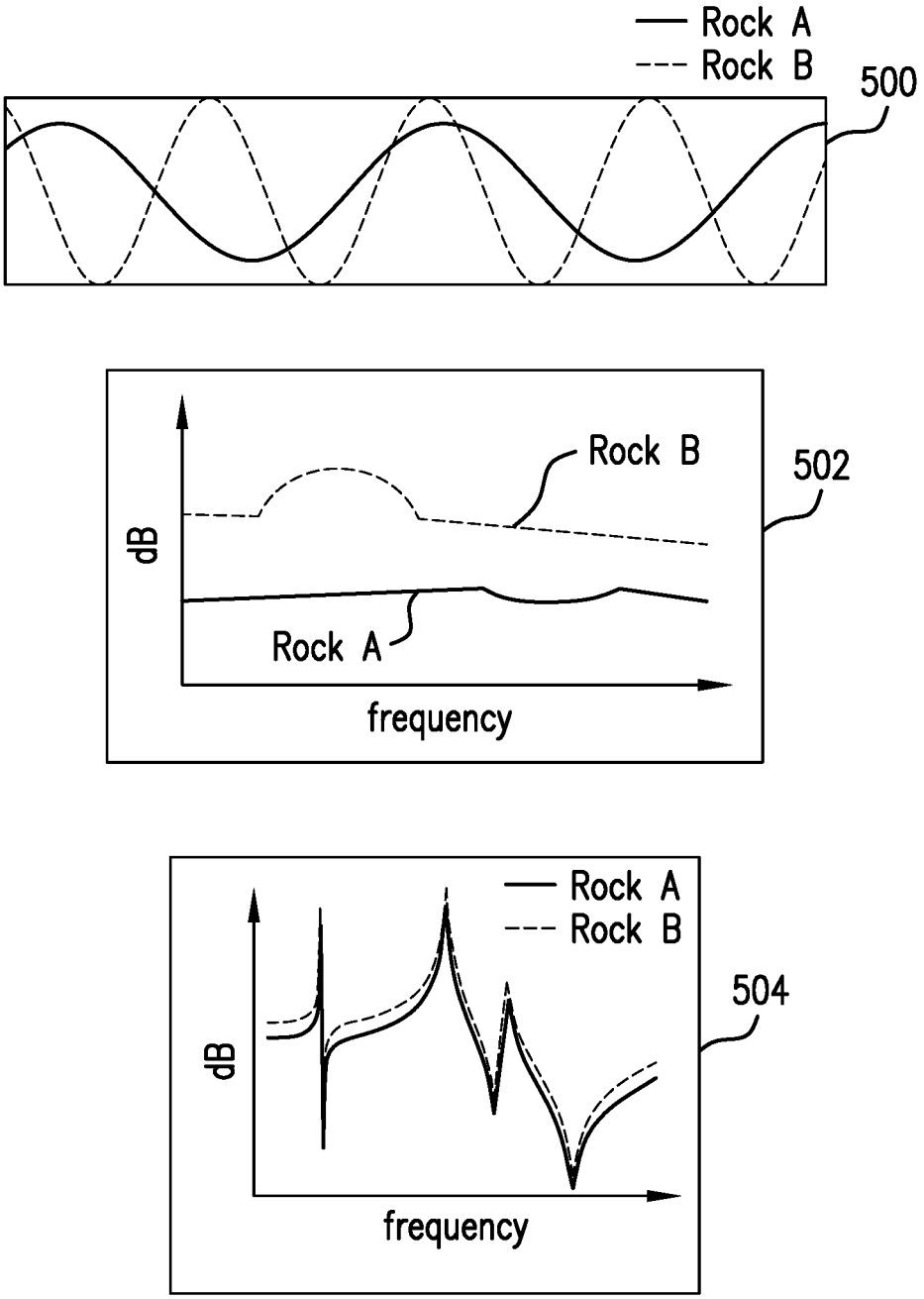
FIG. 5 illustrates different plots associated with a system response in accordance with an embodiment of the present disclosure.

Referring now to FIG. 5, schematic plots illustrating the spectral density response $S_{xx}(\omega)$ and spectral density $S_{ff}(\omega)$ are shown. In FIG. 5, plot 500 represents measured vibrations as two different rocks are drilled through, with Rock A and Rock B having different measured frequencies and amplitudes of vibration, as schematically shown. Plot 502 represents a force versus frequency graph indicating Rock A and Rock B and is illustrative of the spectral density $S_{ff}(\omega)$.

Plot 504 represents a force versus frequency graph of the system response, and thus is illustrative of the spectral density response $S_{xx}(\omega)$.

The transfer function is used to calculate or estimate the vibrations and the forces and torques that causes such vibrations at the bit. Because the induced vibrations and other dynamic properties are a result of the drilling at the bit, the initial vibrations induced by a formation occur at the bit. These vibrations will propagate through the material of the bit, the BHA, and the borehole string. As the vibrations propagate along the length of the system, the signal will change. Due to this, a transfer function is employed to take the dynamics information signatures obtained at the sensor that is not at the bit and extrapolate to the bit to obtain a dynamics information signature at the bit. The dynamics information signature at the bit is representative for a location along the borehole string or BHA where the bit is located, while the dynamics information signature obtained at the sensor is representative for a location along the borehole string or BHA where the sensor is located. As such, a determination of the formation at the bit or proximate to the bit may be obtained. The dynamics information signature at the bit may be representative for the formation drilled by the bit while the dynamics information data is obtained at the sensor.

An alternative to using the transfer function, is an approach in the time domain with Kalman filter- or Luenberger estimator-like approaches. Herein, the excitation torque and forces at the bit that are not measured are estimated in the time domain using a model of the drilling system and the measurements and signals from vibration sensing (dynamics information sensor). The Kalman filter, as one example, is used to ensure that the estimation is reasonable. From the estimated force/torque, a value similar to an auto spectral density or frequency content of any variable or parameter that is derived or a result of the model or any other property of the signal can be directly calculated. For example, results may include, without limitation, an amplitude of BHA or drilling system or an external force or torque. This is also applicable for a non-stationary response of the system.

As noted above, the dynamics information may be observed or monitored using an array or combination of sensors. For example, a multi-sensor approach (e.g., having tangential acceleration (torsional acceleration) and dynamic torque monitoring capabilities) may be used to efficiently determine and obtain a dynamics information signature for a given drilling operation. For example, by using axial and torsional vibrations measured by tangential acceleration, rotary speed fluctuations, dynamic torsional torque, axial vibrations, and/or weight-on-bit, a dynamics information signature may be obtained. The dynamics information signature obtained at one or more dynamics information sensors may be compared against known signatures or known waveforms for specific formations (e.g., from offset wells, laboratory experiments, etc.), and a best fit may be obtained. In accordance with some embodiments, a transfer function may be used to extrapolate the dynamics information signature at the dynamics information sensor to the bit, which is where the vibration is generated within the BHA. In some such embodiments, the processed dynamics information signature(s) may be compared to known signatures or signals to determine what the new formation is formed from. For example, offset well data and/or data generated in a laboratory setting of the force excited at the bit, using a known formation material (e.g., sandstone, limestone, salt, clay, etc.) may be compared to the calculated force at the bit using the dynamics information data and the transfer function. The comparison allows for identifying a formation material from the dynamics information data measured in the BHA in real-time in a borehole.

In accordance with embodiments of the present disclosure, a transfer function is performed on dynamics information signatures obtained at dynamics information sensors. The transfer function relates the forces that are excited at the bit through a dynamics model of the structure to the sensor signal and the frequency content of the sensor value. Therefore, the forces that lead to the vibration can be calculated from the sensor value if an excitation at the bit is assumed using this kind of transfer function or the inverse of a transfer function. The transfer function can relate the forces at the bit to an amplitude at a sensor position, such as by use of the modal properties of a frequency that is visible in the signal. The transfer function can be a frequency response function for a modal equation of motion which calculates the amplitudes (e.g., displacement, velocity, acceleration) at a position of the drilling system, such as at a sensor position, from a force that is applied with a certain frequency content at another position, such as at the bit. An inverse transfer function can be used to calculate, from the sensor signal (amplitudes), the forces excited at the bit knowing the exact modes by modeling. The forces at the bit and the frequency content of these forces may be characteristic for a certain formation property with certain operational parameter combinations and/or mud properties.

Figure 6:
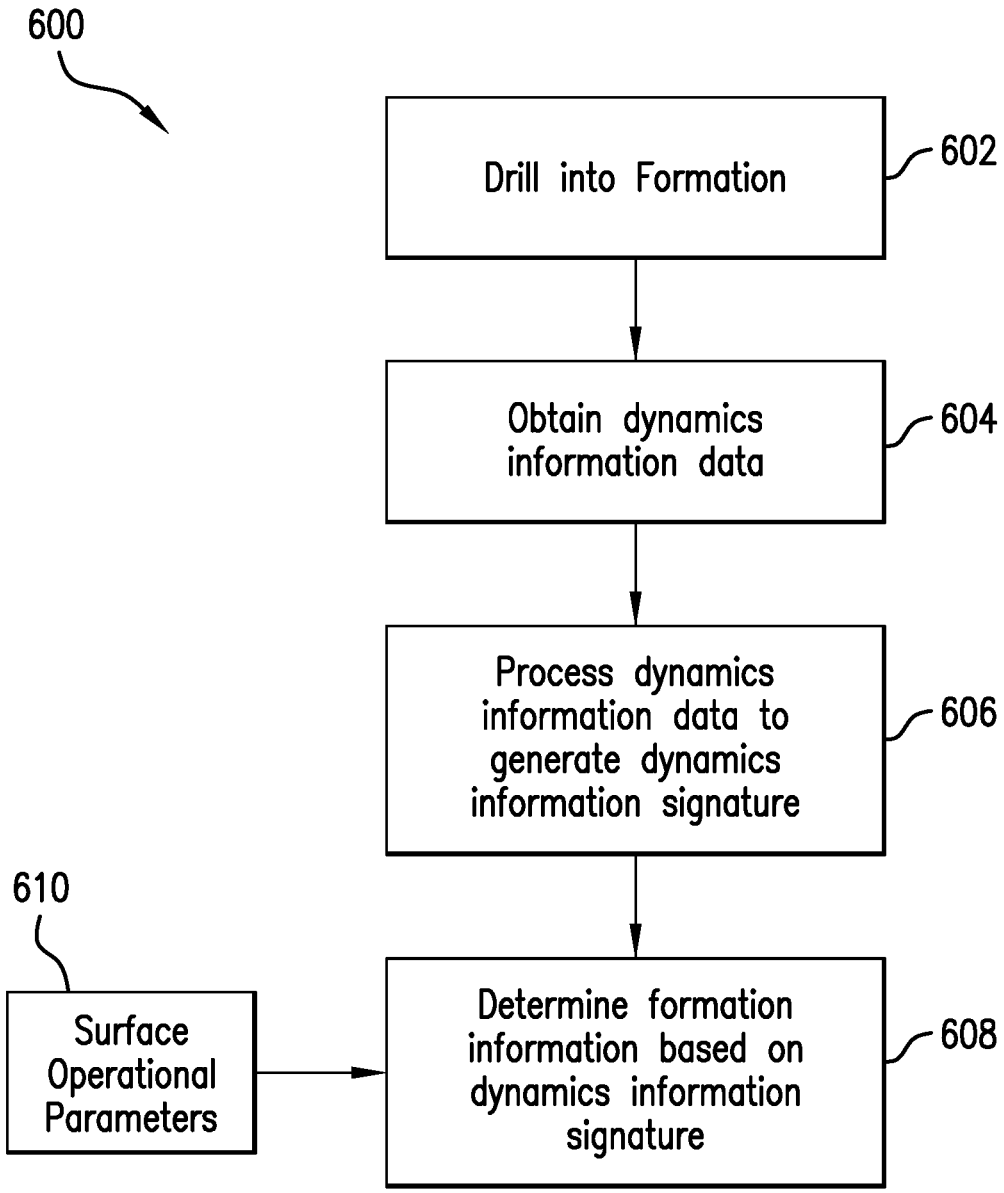
FIG. 6 is a flow process illustrating an embodiment of the present disclosure.

Turning now to FIG. 6, a flow process 600 for performing a drilling operation in accordance with an embodiment of the present disclosure is shown. The flow process 600 may be performed using a downhole system, such as a BHA, as shown and described above. The BHA includes a bit arranged on an end thereof, the bit configured to be driven to cut or bore through subsurface formations, as will be appreciated by those of skill in the art. The BHA, or a string supporting the BHA, includes one or more dynamics information sensors. The dynamics information sensors may be arranged at or in the bit, or at one or more locations uphole from the bit. The BHA may include a controller or other downhole electronics that are arranged in communication with the dynamics information sensor(s) and are configured to process dynamics information signatures/data obtained therefrom. The BHA may also include other formation evaluation tools and sensors and a telemetry assembly or system, as described above.

At block 602 of flow process 600, the BHA is operated to drill into and through a formation to cut a borehole with the earth. In accordance with some embodiments, the drilling operation may include pumping a drilling fluid or mud from the surface, through the BHA to drive the bit, and then the fluid may return uphole through an annulus of the borehole. The pumped fluid may cause the bit to rotate and cut into the earth. It will be appreciated that other types of drilling mechanisms may be used without departing from the scope of the present disclosure, such as rotary drilling using a top drive.

At block 604, the one or more dynamics information sensors are used to obtain dynamics information data. The dynamics information sensors may be vibration sensors, strain gauges, accelerometers, eddy-current sensors, laser displacement sensors, gyroscopes, microphones, vibration meters, velocity sensors, proximity sensors, magnetometers, or the like. The dynamics information data is motion state information (e.g., linear or rotational vibration, linear or rotational movement, linear or rotational acceleration, strain, etc.) that is indicative of induced vibrations and oscillations that are generated in the material of the BHA/tool as a result of the bit-rock interaction. These vibrations may have frequency, amplitude, and potentially multiple orders of excitation (e.g., multiple different frequencies (e.g., harmonics)). As the drilling occurs, the vibrations will propagate through and along the material of the BHA/tool, which will be detected by the dynamics information sensors. The dynamics information sensors may be configured to transmit the detected signal(s) to a controller or other downhole processors.

At block 606, the controller will process the dynamics information data obtained from the dynamics information sensor(s). The processing of the dynamics information data may include applying or employing a transfer function, as described above. The output from such processing is a dynamics information signature representative of the vibration induced at the bit by the cutting force acting on the formation.

At block 608, formation information may be determined based on the dynamics information signature. Such formation information can be indicative of a change from one formation type to another (e.g., change in rock type). This may be observed through a change in amplitude or frequency or other property of the dynamics information signature (e.g., as shown in FIG. 4). However, advantageously, embodiments of the present disclosure may provide more information than a mere change in formation. For example, in accordance with some embodiments, at blocks 606-608, the dynamics information signature may be compared against a look-up table or the like. This comparison can be used to determine properties of the formation directly from the dynamics information data, rather than requiring other formation evaluation tools.

For example, a look-up table may be generated and maintained using laboratory experiments and/or data record in or from offset well. In such embodiments, the look-up table is designed to relate dynamics information signatures to formation properties, such as formation type (e.g., clay, sandstone, limestone, granite, salt, etc.), formation strength, formation density, formation porosity, formation permeability, and the like. As such, in practice, a detected dynamics information signature is compared with the dynamics information signatures in the look-up table to identify the formation or a specific formation property. In some embodiments, the look-up table may also contain drilling parameters and/or mud properties to relate to drilling parameters and/or mud properties present when the dynamics information signature is detected.

In one non-limiting example of flow process 600, a drilling controller may be operated to control a BHA to drill through the earth, at block 602. At blocks 604-606, the controller may obtain dynamics information data and process it to detect a change in spectra (or spectral density) of the dynamics information data, considering downhole operational parameters, as described above. In some embodiments, further information may be provided to the controller from the surface. Such surface-based information can include drilling controls/commands, a well plan and associated data, depth, or the like. When a formation property (e.g., formation change) is detected, a transmission may be sent from the downhole system to the surface, to notify of the change in formation. Alternatively, the formation property may be used to adapt an operational parameters (e.g., drilling controls, drilling commands, etc.) automatically downhole without any interaction with the surface and/or a human operator. As such, in some embodiments, the obtained formation property information may be used for automated geo-steering.

In some embodiments, block 608 may include additional information when determining formation information (properties). For example, surface operation parameter information may be transmitted to the downhole controller, at block 610. The surface operational parameters may include, without limitation, hook load (WOB), flow rate, rotational speed, mud weight, depth, ROP, and the like. This information can be transmitted downhole by known telemetry mechanisms at regular intervals, at user-defined times or instances, or such information may be pre-stored in a memory of the downhole system, or combinations thereof.

In some embodiments, a further step of process 600 may be to obtain formation evaluation data using formation evaluation sensors to confirm the determinations made at block 608. That is, the flow process 600 provides real-time or near-real-time estimates and calculations of formation properties and changes in formations (i.e., a change in properties is indicative of a change in formation). Later in time, as the borehole continues to be drilling, conventional formation evaluation tools may be used to verify the determination made through the dynamics information process of flow process 600. The verification of determination (e.g., calibration) may be performed downhole by the controller, or may be performed at the surface, after the data is transmitted by telemetry to the surface.

The flow process 600 may be performed without additional programming and/or processing beyond that described. That is, the formation evaluation may be based on look-up tables or the like, where a detected and measured dynamics information signal is processed to determine the type of formation (or formation change) through which a bit is cutting. The transfer function allows for dynamics information sensors located a distance from the bit to provide information to estimate the formation at the bit, and thus avoid or reduce the lag associated with the travel required for conventional formation evaluation tools. It will be appreciated that further processing may be incorporated into embodiments of the present disclosure.

Figure 7:
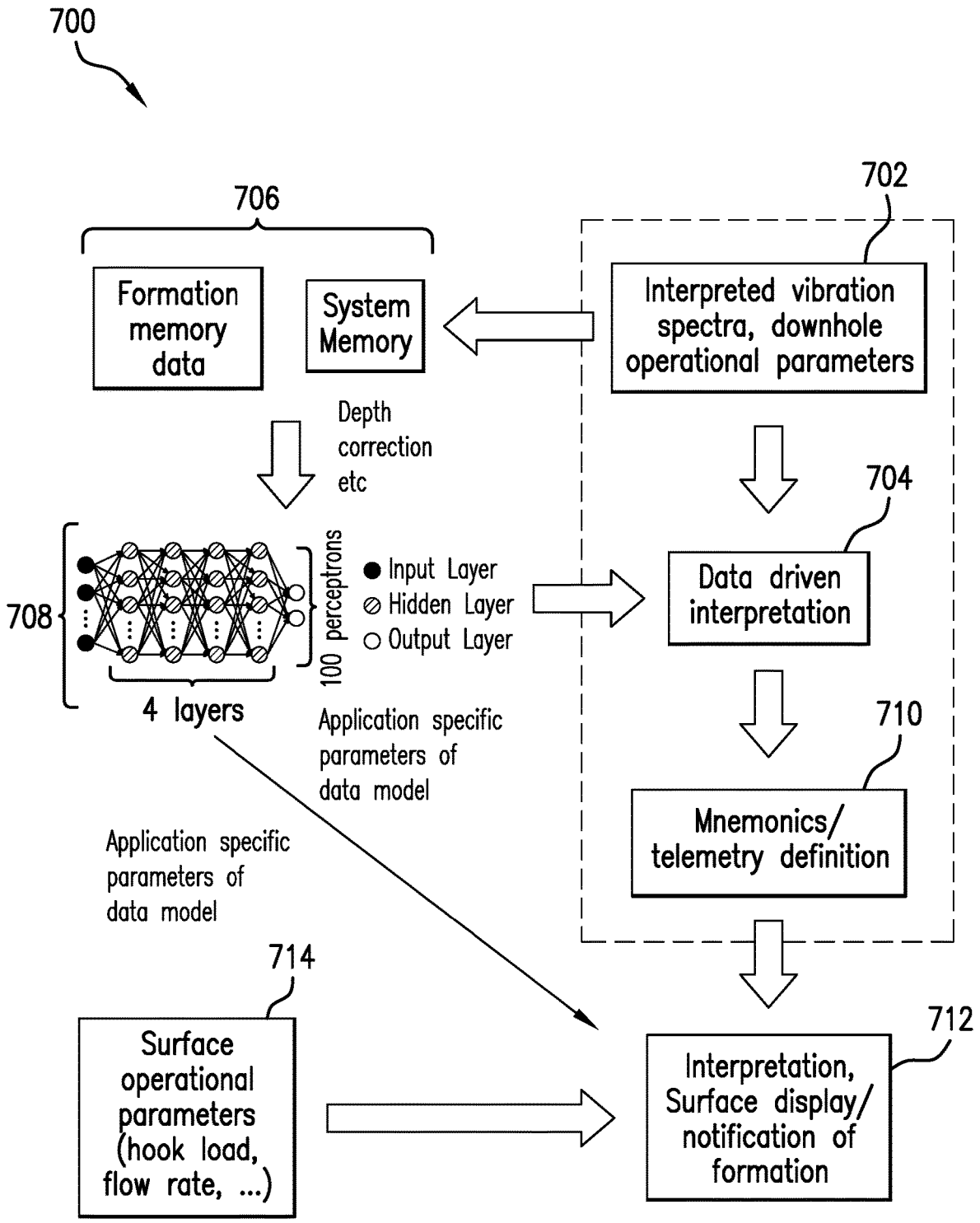
FIG. 7 is a flow process illustrating an embodiment of the present disclosure.

For example, referring now to FIG. 7, a flow process 700 in accordance with an embodiment of the present disclosure is shown. The flow process 700 may be similar to that of flow process 600 and may be performed using one or more of the tools and systems described herein.

Block 702 begins with an initial interpretation and processing of a dynamics information signal detected at a dynamics information sensor along a BHA or string providing dynamics information data. At block 702, vibration spectra, based on the dynamics information data, are interpreted in view of operational parameters, similar to the process described with respect to FIG. 6 and flow process 600. Block 702 may involve a transfer function to extrapolate a dynamics information signal and dynamics information data, respectively, from a sensor to the bit, to thus make an estimate or calculation of a formation that the bit is interacting with.

The processed data from block 702 may input into a data driven interpreter at block 704. Additionally, the processed data from block 702 may be input into a system memory and formation memory data, at block 706 (collectively a correction step). The correction step of block 706 allows for depth correction of data and other processing. The depth correction is meant to have an appropriate comparison between a formation measurement and the vibration measurement. For the depth correction, the bit depth plus the axial position of the sensor where a measurement is taken is linked to the time that the signal is physically observed in a downhole tool (e.g., at the sensor). This is done for every sensor that is used. As mentioned, a conventional/typical formation evaluation tool will measure the same formation substantially later in time compared to a measurement directly at the bit because of the formation evaluation tool sensor being offset from the bit by a distance.

In a same manner, a dynamics information signal measurement can be assumed to be taken at the time when the bit drills the formation because the vibrational excitation will be measured a very short time frame after it is excited at a sensor within the BHA. That is, the vibrational excitation will propagate quickly along the BHA to a sensor, at a rate significantly faster than a drilling rate (ROP). If a vibration signature shall be linked to a formation property that is measured by a formation evaluation tool, this needs to be considered. Formation evaluation tool measurements and vibration measurements may be correlated using a time-depth correction. For example, the depth when the measurement is physically available at the sensor is taken for both the dynamics information sensor and the formation evaluation sensor. With a time-depth profile incorporating a sensor offset between the sensors, the time is determined at the bit-depth for both measurements, which will be significantly later and deeper (plus sensor offset) for the formation evaluation tool (if not measured at the bit). In accordance with some embodiments, comparison between dynamics information and formation evaluation information may be achieved through by taking the times from the first measurement (dynamics measurement) at a certain depth of the physical measurement and of the second measurement (formation evaluation measurement, e.g., density) at the same depth (but another time) to benchmark the dynamics information measurement against the reference of the formation evaluation tool.

The correction step of block 706 may be input into a machine learning operation at block 708. The machine learning operation may include artificial neural networks, supervised learning using labeled data, unsupervised learning using unlabeled data, reinforcement learning using feedback, or other types of artificial intelligence processing of the data. The learning operations may be based on cluster techniques, regressions or fuzzy logics and similar algorithms that are meant to map an input to an output algorithm based on data and physical interpretation. Physical interpretation may be any questions that are based on mathematical, statistical, or physical modeling used for further interpretation of the data for more consistent use in the learning algorithm. The output from the machine learning operation of block 708 may also be an input to the data driven interpreter of block 704.

At block 710, the data is input to mnemonics/telemetry definition for the purpose of telemetry. For example, the data may be sent to the surface via mud pulse telemetry. For this purpose data words are defined that send the information from the downhole tools to the surface via pulses in the mud channels. There is a decoding device at the surface and an active device that creates pulses in the BHA. The data words need to be defined for a smooth communication. The data words can be related to a physical value such as, for example, an estimated formation property or the data words may provide an alarm of a formation change detected. The data words may be a single bit value. A single bit value is beneficial because the telemetry bandwidth is low for such a transmission. In some embodiments, a number defining a formation may be employed, where, for example, a "1" could be linked to a first formation that is known to occur in the application, and a "2" could be linked to a second formation that is known to occur, etc. In some such embodiments, a value may be included for indicating that an unknown formation is detected (e.g., a value of "3" can mean "unknown formation").

At block 712, a processor is used to make an interpretation of the formation which a bit is currently interacting with. The processor may receive as inputs an output from block 710 (mnemonics/telemetry definition), block 708 (machine learning/application specific parameters of data model), and from block 714 (surface operation parameters). At block 712, the interpretation of the formation at the bit may be transmitted to the surface by known telemetry mechanisms, and a display of the formation and/or notification thereof may be generated to inform an operator of a change in formation, or provide information of the information being drilled into.

Advantageously, in accordance with embodiments of the present disclosure, by adding transfer function information, the described processes may be transferable between different BHAs. The reason is that the FFT at the bit is the characteristic which can be calculated with the transfer function between the bit and the sensor. For example two runs could be conducted in a similar environment known to have the same formations. It may be assumed that the excitation at the bit is similar in each formation. The measurement at the sensor is then defined by the transfer function that is BHA-specific and transfers the force excitation at the bit to the sensor mathematically. The transfer function can also be used to reconstruct the forced, noisy, or stochastical excitation at the bit (or using Kalman filter approaches and similar approaches).

For example, first it may be assumed that the relationship of the amplitude at the bit and the force of the excitation at the bit is linear. That is, it may be assumed that the force is not changed due to the amplitude at the bit. This assumption can be used to approximate a non-linear system and thus may provide reasonable results. The force at the bit is then independent of the BHA configuration. That is, for a first BHA, the data is available and the forced (noisy, stochastical) excitation can be calculated at the bit using a first transfer function associated with the first BHA. Then, for a second BHA, this excitation can be used to calculate the expected sensor measurement for the second BHA using a second transfer function associated with the second BHA. Therefore, for one environment using the transfer functions of the first BHA and the second BHA, the experience or measurement can be transferred between runs with different BHAs. If the system is strongly non-linear (i.e., the force or torque at the bit is dependent on the amplitude at that position), both the amplitude and force component may be used as a representative value for the BHA (e.g., a force at the bit and the amplitude dependency of this force). Common methods to derive the non-linearity can be used, such as non-linear model analysis, to identify the type of non-linearity. With this information, the amplitude dependency of the torque or force that is representative of the formation property may be calculated.

In accordance with embodiments of the present disclosure, vibration and other dynamics information sensors may be arranged at or near a bit or otherwise disposed along a length of a BHA or downhole string. These sensors can provide for faster or more immediate identification of formation changes and/or formation evaluation, as compared to conventional sensor(s). In accordance with embodiments of the present disclosure, analysis of a vibration or other dynamics information signal and applying a transfer function to extrapolate the information to the position of the bit allowed for determinations of various formation properties (e.g., change in formation, determination of material of formation, etc.). In some embodiments, a comparison between the processed dynamics information data (e.g., applied transfer function) with a known signal representative of a formation material allows for determination of a specific formation type. In some embodiments, monitoring for dramatic changes (e.g., beyond a preset threshold) allows for determination that a new formation is entered or the formation properties have changed.

Advantageously, the transfer function may be used to analyze the vibration signature (in the dynamics information data) at a sensor to calculate what is occurring at the bit, and thus near real-time response to changes in formation may be achieved. This process is significantly faster than use of conventional formation evaluation tools, which may require delays associated with additional travel to position the sensor(s) proximate to the appropriate formation/formation change. In contrast, by monitoring vibrations and/or other dynamics information, the sensors are not required to be located near the specific formation, as these sensors are not arranged to directly monitor the formation, but rather extrapolate formation properties by monitoring how the bit interacts with the formation materials and the vibrations and dynamics interactions between the bit and the formation. As such, a near-instantaneous estimate or calculation of the formation properties (or formation changes) may be obtained through monitoring of dynamics information signals and data.

Set forth below are some embodiments of the foregoing disclosure:

Embodiment 1: A method for determining formation properties in subsurface operations, the method comprising: drilling into a formation with a disintegrating device disposed on a downhole string; monitoring dynamics information signals in the downhole string with a dynamics information sensor to obtain dynamics information data; applying a transfer function to the dynamics information data to obtain a dynamics information signature; and analyzing the dynamics information signature to determine a formation property of the formation drilled by the disintegrating device.

Embodiment 2: The method of any preceding embodiment, wherein the downhole string defines a longitudinal axis and the dynamics information sensor is located a distance remote from the disintegrating device along the longitudinal axis.

Embodiment 3: The method of any preceding embodiment, wherein the transfer function includes a Kalman Filter.

Embodiment 4: The method of any preceding embodiment, wherein the transfer function is characteristic for the downhole string and the transfer function is dependent upon a configuration of the downhole string, wherein the configuration of the downhole string includes at least one of a diameter of the downhole string and a material property of the downhole string.

Embodiment 5: The method of any preceding embodiment, further comprising: obtaining first dynamics information data in a first downhole string including a first bottomhole assembly while drilling in the formation in an offset well; and predicting second dynamics information data, detected in a second downhole string including a second bottomhole assembly having the disintegrating device while drilling into the formation, by using a first transfer function associated with the first bottomhole assembly and a second transfer function associated with the second bottomhole assembly.

Embodiment 6: The method of any preceding embodiment, wherein the transfer function relates a force at the disintegrating device and an amplitude of the dynamics information data.

Embodiment 7: The method of any preceding embodiment, wherein the dynamics information data is acceleration data.

Embodiment 8: The method of any preceding embodiment, wherein the downhole string defines a longitudinal axis, the dynamics information sensor is located in the downhole string at a first location along the longitudinal axis, and the dynamics information data is representative for the first location and the obtained dynamics information signature is representative for a second location on the downhole string along the longitudinal axis.

Embodiment 9: The method of any preceding embodiment, wherein the second location on the downhole string is at the disintegrating device arranged at an end of the downhole string.

Embodiment 10: The method of any preceding embodiment, wherein the disintegrating device is a reamer.

Embodiment 11: The method of any preceding embodiment, wherein the transfer function comprises a mathematical relationship between an amplitude and frequency at the dynamics information sensor and an amplitude and frequency at the disintegrating device.

Embodiment 12: The method of any preceding embodiment, further comprising adjusting the subsurface operation based on the determined formation property.

Embodiment 13: The method of any preceding embodiment, further comprising applying machine learning on the dynamics information signature prior to determining the formation property.

Embodiment 14: The method of any preceding embodiment, wherein the formation property is a change in formation material determined from a change in at least one aspect of the dynamics information signature over time.

Embodiment 15: The method of any preceding embodiment, wherein the determination of the formation property is based, in part, upon surface operational parameters associated with the subsurface operation.

Embodiment 16: The method of any preceding embodiment, further comprising: evaluating the formation using a formation evaluation tool; and validating the formation property determined from the analysis of the dynamics information signature based on the formation evaluation tool evaluation.

Embodiment 17: A system for determining formation properties in subsurface operations, the system comprising: a disintegrating device disposed on a downhole string and configured to drill into a formation; a dynamics information sensor arranged on the downhole string and configured to obtain dynamics information data from dynamics information signals induced in the downhole string due to a drilling operation with the disintegrating device; and a controller configured to: receive the dynamics information data and apply a transfer function to the dynamics information data to obtain a dynamics information signature; and analyze the dynamics information signature to determine a formation property of the formation drilled by the disintegrating device.

Embodiment 18: The system of any preceding embodiment, wherein the dynamics information sensor comprises at least one vibration sensor.

Embodiment 19: The system of any preceding embodiment, wherein the disintegrating device is arranged at an end of the string.

Embodiment 20: The system of any preceding embodiment, wherein the disintegrating device is a reamer.

Embodiment 21: The system of any preceding embodiment, wherein the transfer function comprises a mathematical relationship between an amplitude and frequency at the dynamics information sensor and an amplitude and frequency at the disintegrating device.

Embodiment 22: The system of any preceding embodiment, wherein the controller is configured to adjust the subsurface operation based on the determined formation property.

Embodiment 23: The system of any preceding embodiment, wherein the controller is configured to apply machine learning on the dynamics information signature prior to determining the formation property.

Embodiment 24: The system of any preceding embodiment, wherein the formation property is a change in formation material determined from a change in at least one aspect of the dynamics information signature over time.

Embodiment 25: The system of any preceding embodiment, wherein the determination of the formation property is based, in part, upon surface operational parameters associated with the subsurface operation.

Embodiment 26: The system of any preceding embodiment, further comprising: a formation evaluation tool configured to evaluate the formation; and the controller is configured to validate the formation property determined from the analysis of the dynamics information signature based on information received from the formation evaluation tool.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" can include a range of ±8% or 5%, or 2% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A method for determining earth formation properties during a subsurface operation, the method comprising:

disposing a downhole string into a borehole in an earth formation;

drilling into the earth formation with a disintegrating device disposed on the downhole string, the drilling causing vibrations of the downhole string;

detecting, using a dynamics information sensor, the vibrations of the downhole string to provide dynamics information signals;

monitoring, at a processing unit, the dynamics information signals to obtain dynamics information data;

performing, using the processing unit, a mathematical calculation by applying a transfer function to the dynamics information data to calculate a dynamics information signature, wherein the transfer function relates a force at the disintegrating device and an amplitude of the dynamics information data;

analyzing, using the processing unit, the calculated dynamics information signature to determine an earth formation property of the earth formation drilled by the disintegrating device; and steering the disintegrating device, using the processing unit, in response to the determined earth formation property.

2. The method of claim 1, wherein the downhole string defines a longitudinal axis and the dynamics information sensor is located a distance remote from the disintegrating device along the longitudinal axis, where the dynamics information data are representative for high-frequency torsional oscillations of 50 Hz or greater.

3. The method of claim 1, wherein the transfer function includes a Kalman Filter.

4. The method of claim 1, wherein the transfer function is characteristic for the downhole string and the transfer function is dependent upon a configuration of the downhole string, wherein the configuration of the downhole string includes at least one of a diameter of the downhole string and a material property of the downhole string.

5. The method of claim 1, further comprising:

obtaining first dynamics information data in a first downhole string including a first bottomhole assembly while drilling in the earth formation in an offset well; and predicting second dynamics information data detected in a second downhole string including a second bottomhole assembly having the disintegrating device while drilling into the earth formation, by using a first transfer function associated with the first bottomhole assembly and a second transfer function associated with the second bottomhole assembly.

6. The method of claim 1, further comprising performing the steering of the disintegrating device automatically by the processing unit in response to the determined earth formation property.

7. The method of claim 1, wherein:

the downhole string defines a longitudinal axis, the dynamics information sensor is located in the downhole string at a first location along the longitudinal axis, and the dynamics information data is representative for the first location and the calculated dynamics information signature is representative for a second location on the downhole string along the longitudinal axis.

8. The method of claim 7, wherein the second location on the downhole string is at the disintegrating device arranged at an end of the downhole string.

9. The method of claim 1, wherein the transfer function comprises a mathematical relationship between an amplitude and frequency of vibrations at the dynamics information sensor and an amplitude and frequency of vibrations at the disintegrating device.

10. The method of claim 1, further comprising applying machine learning on the calculated dynamics information signature prior to determining the formation property.

11. The method of claim 1, wherein the earth formation property is a change in earth formation material determined from a change in at least one aspect of the calculated dynamics information signature over time.

12. The method of claim 1, wherein the determination of the earth formation property is based, in part, upon a surface operational parameter associated with the steering of the disintegrating device.

13. The method of claim 12, wherein the surface operational parameter is at least one of a hook load, a depth, a rate of penetration, a flow rate, a mud weight, a rate of penetration, and a fluid pressure.

14. The method of claim 1, further comprising:

evaluating the earth formation using a formation evaluation tool; and validating the earth formation property determined from the analysis of the calculated dynamics information signature based on the formation evaluation tool evaluation.

15. The method of 1, further comprising using the determined formation property to adapt at least one of a drilling control and a drilling command.

16. A system for determining earth formation properties in a subsurface operation, the system comprising:

a disintegrating device disposed on a downhole string and configured to drill into an earth formation, the downhole string vibrating while drilling into the earth formation;

a dynamics information sensor arranged on the downhole string and configured to obtain dynamics information signals induced in the downhole string due to the vibration of the downhole string;

a processing unit arranged on the drilling system and configured to:

receive the dynamics information signals from the dynamics information sensor and provide dynamics information data;

perform a mathematical calculation by applying a transfer function to the dynamics information data to obtain a dynamics information signature, wherein the transfer function relates a force at the disintegrating device and an amplitude of the dynamics information data;

analyze the obtained dynamics information signature to determine an earth formation property of the earth formation drilled by the disintegrating device; and steer the disintegrating device in response to the determined formation property.

17. The system of claim 16, wherein the dynamics information sensor comprises at least one vibration sensor, and the dynamics information data are representative for high-frequency torsional oscillations of 50 Hz or greater.

18. The system of claim 16, wherein the processing unit is configured to apply machine learning to the obtained dynamics information signature prior to determining the earth formation property.

19. The system of claim 16, further comprising:

a formation evaluation tool configured to evaluate the earth formation; and wherein the processing unit is configured to validate the earth formation property determined from the analysis of the obtained dynamics information signature based on information received from the formation evaluation tool.

20. The system of claim 16, further including a rotary steerable system, the rotary steerable system used to steer the disintegrating device in response to the determined formation property.

* * * * *